United States Patent [19]

Howard

[11] 4,030,781

[45] June 21, 1977

[54] HEADREST

[76] Inventor: Harold P. Howard, 8451 W. Ten Mile Road, Oak Park, Mich. 48237

[22] Filed: Jan. 21, 1976

[21] Appl. No.: 651,031

[52] U.S. Cl. ..... 297/397; 297/410

[51] Int. Cl.[2] ..... A47C 7/36

[58] Field of Search ..... 297/410, 397, 377

[56] References Cited

UNITED STATES PATENTS

| | | | |
|---|---|---|---|
| 290,644 | 12/1883 | Koenig | 297/397 |
| 2,450,783 | 10/1948 | Collins | 297/377 X |
| 2,765,840 | 10/1956 | Robert et al. | 297/410 X |
| 2,789,625 | 4/1957 | Christie | 297/410 X |
| 3,027,194 | 3/1962 | Rumptz | 297/410 |
| 3,063,751 | 11/1962 | Hatch | 297/410 |
| 3,253,859 | 5/1966 | Merriman et al. | 297/397 |
| 3,507,538 | 4/1970 | Stoller | 297/410 |
| 3,784,253 | 1/1974 | Kohler et al. | 297/410 |

*Primary Examiner*—Roy D. Frazier
*Assistant Examiner*—Darrell Marquette
*Attorney, Agent, or Firm*—Andrew R. Basile

[57] ABSTRACT

An improved detachable headrest, specifically intended for lawn chairs. The headrest has a metal or plastic frame featuring adjustable height means and quick release design.

3 Claims, 4 Drawing Figures

FIG-1
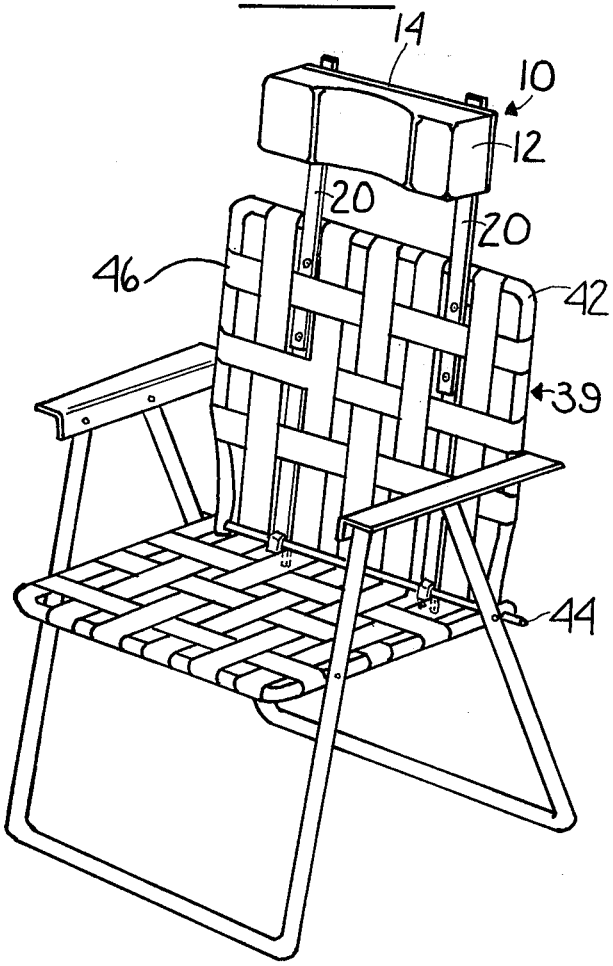
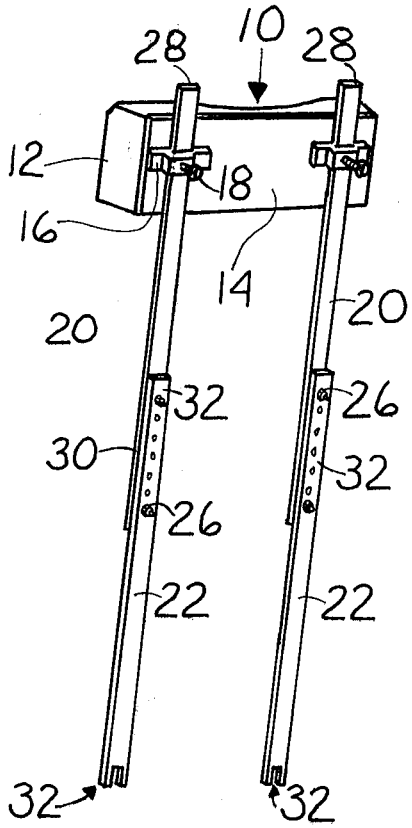
FIG-2
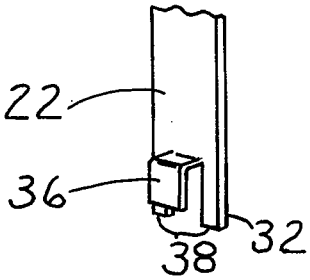
FIG-3
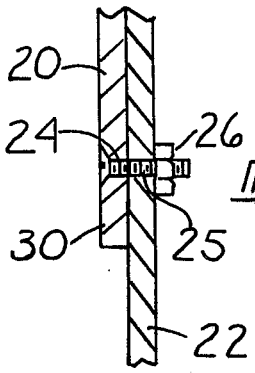
FIG-4

HEADREST

BACKGROUND OF THE INVENTION

I. Field of the Invention

This present invention relates to an improved headrest and, particularly, to an improved headrest which is adaptable to lawn chairs and, furthermore, is adaptable to a range of heights for accommodating variable sizes of people and chairs.

II. Description of the Prior Art

Headrests have long been on the scene, and their appearance in recreational apparatus is well known. One example of an application of a headrest is the floating lounge chair designed to support a person in a pool or other such body of water. The problem with this and similar headrests is that they are permanently attached to the chair and if, as in the case of the floating chair, the pillow portion should break, the headrest cannot be replaced. Examples of prior art structures which incorporate headrests which attempt to overcome the aforementioned difficulties are disclosed in U.S. Pat. Nos. 2,450,783; 3,507,538; and 3,784,253.

SUMMARY OF THE INVENTION

The present invention, which will be described in greater detail hereinafter, comprises an improved detachable headrest having a metal or plastic frame that may be adjusted to varying heights.

It is therefore an object of the present invention to provide an improved headrest of the type that can be releasably attached to a chair and, in particular, to a lawn chair so that if a portion of the headrest breaks, it may be removed and replaced.

It is also an object of this invention to provide a headrest that can be adjusted in height so that if a tall person uses the chair, the pillow portion can be aligned with this head, and correspondingly if a shorter height is desired, the headrest can be favorably adjusted.

It is a further object of this present invention to provide a detachable, adjustable headrest of simple and inexpensive construction permitting anyone to purchase and successfully attach such a headrest to a lawn chair having a tubular frame.

Other objects, advantages, and applications of the present invention will become apparent to those skilled in the art of headrests when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like components throughout the several views, and in which;

FIG. 1 is a perspective view of the present invention in the form of a headrest attached to a conventional lawn chair;

FIG. 2 is a perspective view of the headrest illustrated in FIG. 1;

FIG. 3 is a fragmentary, perspective, frontal view of the headrest illustrated in FIG. 2; and FIG. 4 is a fragmentary cross-sectional view of the headrest illustrated in FIGS. 1 and 2.

DESCRIPTION OF THE PREFERRED EMBODIMENT

Referring now to the drawing and, in particular, to FIG. 2 wherein there is illustrated one example of the present invention in the form of a headrest 10 comprising a pillow 12 having a rectangular metal or plastic plate 14, generally conforming to the shape of the pillow 12 and fixedly and permanently attached to the pillow 12 by any suitable means such as by means of an adhesive. A pair of identical, longitudinal metal or plastic upper strips 20 are positioned in a substantially parallel relationship, each strip 20 comprising a pillow attaching end 28 which slidably engages the rectangular metal plate 14 by means of a bracket 16 and screw 18, and an end 30 opposite the pillow attaching end 28 carrying a plurality of apertures 24 (FIG. 4). The brackets 16 are attached to the back side of the metal plate 14 by any suitable means such as by welding or the like.

The headrest 10 further comprises a second pair of identical, longitudinal metal or plastic strips 22, each strip 22 comprising a chair attaching end 32 and an end 34 opposite the chair attaching end 32, carrying a plurality of apertures 25 (FIG. 4). The metal strips 22 are joined to the first pair of metal strips 20 by selectively aligning the respective apertures 24 and 25, respectively, on the ends 30 and 34 so that a desired height of the headrest 10 is obtained. Screw and nut arrangements 26 then releasably attach the adjustable strips.

As can be seen in FIG. 3, the chair attaching end 32 of each of the lower strips 22 comprises a cut-out portion forming a hook member 36 and two legs 38 which function in a manner described hereinafter.

In practical use, after the desired height of the headrest is obtained by adjusting the upper and lower strips 20 and 22 in the manner previously described, the headrest 10 is attached to a lawn chair 39, as shown in FIG. 1. The joined strips 20 and 22 are inserted through a web 46 near the top of the chair back so that the upper strips 20 rest against the upper tubular frame 42 of the lawn chair 39. The chair attaching end 32 of each of the lower strips 22 tightly engages in a snap-lock fashion the rear seat tubular frame member 44 of the lawn chair 39 by means of the hook member 36 and legs 38. Thus secured, the headrest is rendered usable to anyone occupying the chair 39. A simple adjustment of the screws 26 accommodates a taller or shorter positioned occupant or a longer or shorter backed lawn chair, and a quick release of screws 18 permits a new pillow 12 and rectangular plate 14 combination to replace a worn or damaged previous set. The screw 18 and bracket 16 arrangement permits for additional adjustment of the height of the headrest 10.

Although only one example of the present invention has been disclosed, it should be understood by those skilled in the art of headrests that other forms of applicant's invention may be had, all coming within the spirit of the present invention and the scope of the appended claims.

What is claimed is as follows:

1. A headrest and lawn chair combination comprising:

a pillow;

a support plate fixedly attached to said pillow and generally conforming to the shape of said pillow;

two upper longitudinal members positioned substantially parallel to each other, each one of said upper members having a pillow attaching end and an opposite lower end;

means carried by said plate to releasably attach said upper members to said plate at said pillow attaching end of each of said upper members;

two lower longitudinal members, each one of said lower members having a chair attaching end and an opposite upper end;

means releasably and adjustably joining said lower end of each of said upper members to said upper end of each of said lower members permitting a selected range of total lengths for the resulting combination;

U-shaped attaching elements formed on the chair attaching ends of each of said lower members, said elements each having a base section carried by said lower members and downwardly disposed legs;

a lawn chair having a horizontally disposed seat frame and an upright, U-shaped back frame, said back frame having an upper base section and downwardly disposed legs, the ends of which are pivotally connected to said seat frame;

a horizontally disposed connecting rod pivotally connecting said back frame legs to said seat frame;

means supporting said seat and back frames, respectively, in said horizontal and upright positions; and a plurality of interwoven webs carried by said back frame, said headrest upper and lower members being positioned through said interwoven webs such that a portion of said upper members abuts a forward portion of said back frame base section and said U-shaped attaching elements engage said horizontal connecting rod, said legs of each of said U-shaped attaching element being spaced a sufficient distance from each other and of a sufficient flexibility that said U-shaped attaching elements will tightly engage said horizontal connecting rod in a snap-lock fashion to securely and releasably attach said headrest to said lawn chair.

2. The headrest defined in claim 1 wherein said upper members and said lower members are fabricated from a metal.

3. The headrest defined in claim 1 wherein said members are fabricated from a plastic material.

* * * * *